US005848546A

United States Patent [19]

Allison et al.

[11] Patent Number: 5,848,546

[45] Date of Patent: Dec. 15, 1998

[54] METHOD OF GRIPPING TUBULAR MEMBERS DURING FORMING OPERATIONS AND ASSOCIATED APPARATUS

[75] Inventors: Blair T. Allison, Cheswick; Daniel Bergstrom, Sarver; Lawrence W. Cisko, Harrison City; William A Graham, McDonald; Daniel E. Hunter, Export; Jeffrey M. Shoup, Delmont, all of Pa.

[73] Assignee: Aluminum Company of America, Pittsburgh, Pa.

[21] Appl. No.: 757,403

[22] Filed: Nov. 27, 1996

[51] Int. Cl.[6] ..... B21D 9/00; B21D 11/02

[52] U.S. Cl. ..... 72/296; 72/302

[58] Field of Search ..... 72/296, 297, 302, 72/62, 58

[56] References Cited

U.S. PATENT DOCUMENTS 5,327,764 7/1994 Weykamp et al. ..... 72/296

*Primary Examiner*—Daniel C. Crane

*Attorney, Agent, or Firm*—Arnold B. Silverman; Daniel C. Abeles; Thomas R. Trempus

[57] ABSTRACT

A method of gripping a metal tubular member during a forming operation to resist damage to the gripped ends and reduce scrap, includes providing an outer tool having a recess structured to receive an end of the tubular member, inserting a resilient mandrel into the end of the tubular member and inserting the tubular member end into the recess. A compressive force is applied to the resilient member in a direction aligned generally axially of the tubular member to establish transverse expansion of the resilient member in order to clamp the tubular member end between the mandrel and the outer tool recess. The tube may be stretched beyond the yield point and formed while so clamped, after which the compressive force is removed so as to facilitate withdrawal of the formed tube. In one embodiment, the mandrel may consist of a composite which may have a lower durometer hardness inner portion and higher durometer hardness outer portions. In another embodiment, a substantially rigid mandrel is received within the tube end and an annular resilient sleeve is positioned on the outside of the tube end. The method may be used for a wide variety of purposes including forming structural vehicular members. Associated apparatus is provided.

63 Claims, 8 Drawing Sheets

METHOD OF GRIPPING TUBULAR MEMBERS DURING FORMING OPERATIONS AND ASSOCIATED APPARATUS

BACKGROUND OF THE INVENTION

1. Field of the Invention

The present invention relates to a method of gripping one or more ends of a tubular member, such as a hollow metal extrusion as part of the forming operation, while resisting damage to the ends and to related apparatus.

2. Description of the Prior Art

It has been known to grip hollow metal workpieces at the ends so as to facilitate control, stretching, and adequate retention during forming operations. It has been known to employ stretch forming of hollow aluminum extrusions by gripping the ends in opposed jaws, after which the hollow tubular member is stretched beyond the yield point and then wrapped around a die to obtain the desired contour by bending. See generally U.S. Pat. No. 5,327,764.

Unfortunately, in some prior art practices, significant deformation of the tubular member may occur in the grip region, thereby requiring that portion be scrapped. Also, additional scrap occurs as a result of the supporting machine structure for conventional gripper mechanisms as a result of the need to provide clearance between the bend die and other moving parts of the machine. It has been estimated that depending upon the particular part design, the amount of scrap due to losses in the ends of a tubular member may be as much as 30 percent.

There remains, therefore, a very real and substantial need for improved means for forming tubular members in such a way as to minimize scrap due to loss in the ends of the workpiece during forming.

SUMMARY OF THE INVENTION

The present invention has met the above-described needs by providing a method of gripping a metal tubular member during forming, while resisting damage thereto.

In a preferred embodiment of the method, an outer tool has a recess structured to receive an end of the tubular member. A resilient mandrel is inserted into the tubular member end and the end is inserted into a recess in the outer tool. By applying a compressive force to the resilient mandrel in a direction generally axially with respect to the tubular member, transverse expansion of the resilient member is effected in order to provide strong clamping of the tubular member between the expanded resilient mandrel and the lateral surface of the recess of the outer tool. Once clamped, the forming may take place, after which withdrawal of the compressive force causes the resilient mandrel to retract transversely, thereby facilitating removal of the formed workpiece from the end clamping means. The compressive force applied to the resilient mandrel may be sufficient to actually deform the end of the tubular member to effect end sizing.

The compressive force may advantageously be applied by means of a hydraulic cylinder, which is operatively associated with a rod passing through a passageway in the outer tool and the resilient mandrel and secured to an end cap, such that movement of the rod in a direction toward the hydraulic cylinder, will cause compression of the resilient mandrel between the end cap and the base of the recess, thereby causing transverse expansion. Movement in the opposite direction will withdraw the compressive force and permit the resilient material to contract radially. In another disclosed embodiment, movement of a wedge may effect clamping action.

In another embodiment, the tube end is inserted over a rigid core and an annular rigid outer tool receives a resilient annular sleeve which is interposed between the outer tool and the outer surface of the end of the tubular member. The inner surface of the tubular end is supported by the rigid core. Axial compression of the resilient annular sleeve effects radially inward expansion thereof to clamp the tubular end between the core and the resilient sleeve.

It is an object of the present invention to provide means for clamping the ends of a metal tubular member during a forming operation so as to provide effective clamping while resisting scrap inducing damage to the ends.

It is another object of the present invention to provide a method and apparatus for forming tubular members which involves the transverse expansion of a resilient mandrel effected through generally axial application of a compressive force to the mandrel to thereby clamp the ends of the workpiece between the transversely expanded mandrel and a cooperating rigid tool.

It is another object of the present invention to provide such a system which may be employed with conventional forming techniques and apparatus.

It is a further object of the present invention to provide such a system which may be employed with single or multiple hollow aluminum extrusions in making structural components for vehicles, as well as for other products.

These and other objects of the invention will be more fully understood from the following description on reference to the illustrations appended hereto.

DESCRIPTION OF THE PREFERRED EMBODIMENTS

As employed herein, the term "vehicle" refers to land vehicles including automobiles, trucks, buses, campers, vans and aircraft.

While the present invention finds particular advantageous use in forming tubular members into structural vehicle members, such as space frames, bumpers or roof rails, for example, it is not so limited and may be applied to many other uses wherein tubular members are clamped during a forming operation and it is desired to minimize scrap resulting from such forming operations.

Figure 1:
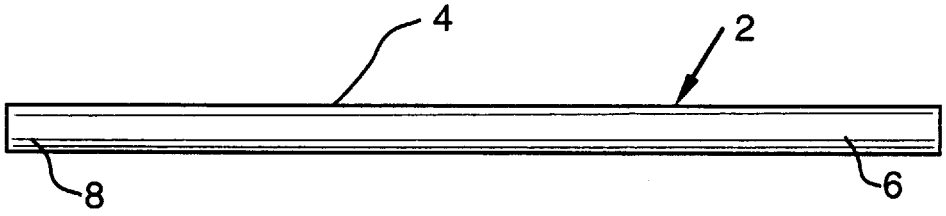
FIG. 1 is a plan view of an aluminum tubular member which is to be formed.
Figure 2:
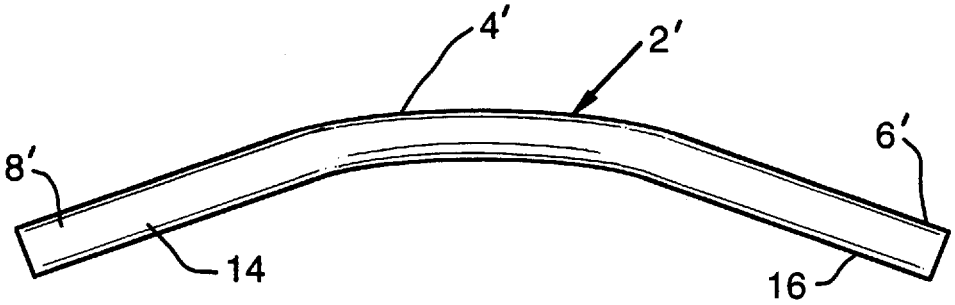
FIG. 2 is a top plan view of an example of a tubular member of FIG. 1 after forming.

Referring to FIG. 1, there is shown a tubular metal member 2, which has a center portion 4, and a pair of end portions 6,8. For convenience of reference herein, the expression "end(s)" will be employed to refer not just to the very end of an article, but also to those portions which would be gripped at or adjacent the physical end during a forming operation. FIG. 2 shows the tubular member of FIG. 1 with similar reference numbers being designated by a prime. In the form shown, the central portion 4' has remained straight while adjacent portions 14,16 have been subjected to permanent bending deformation. If desired, the central portion 4 could be bent. This form of bending may be employed in creating a vehicle bumper or structural roof member, for example.

Figure 3:
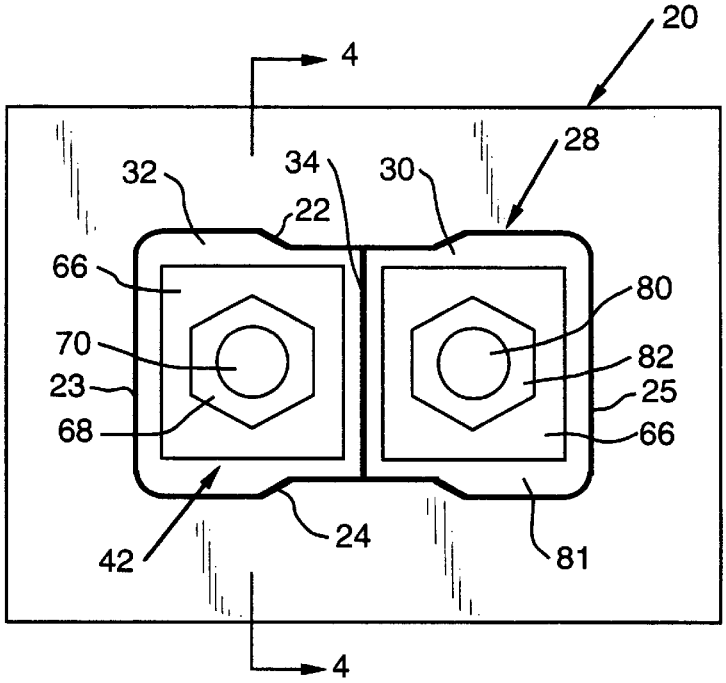
FIG. 3 is a cross-sectional illustration showing a multiple hollow metal extrusion disposed within the apparatus of the present invention.
Figure 4:
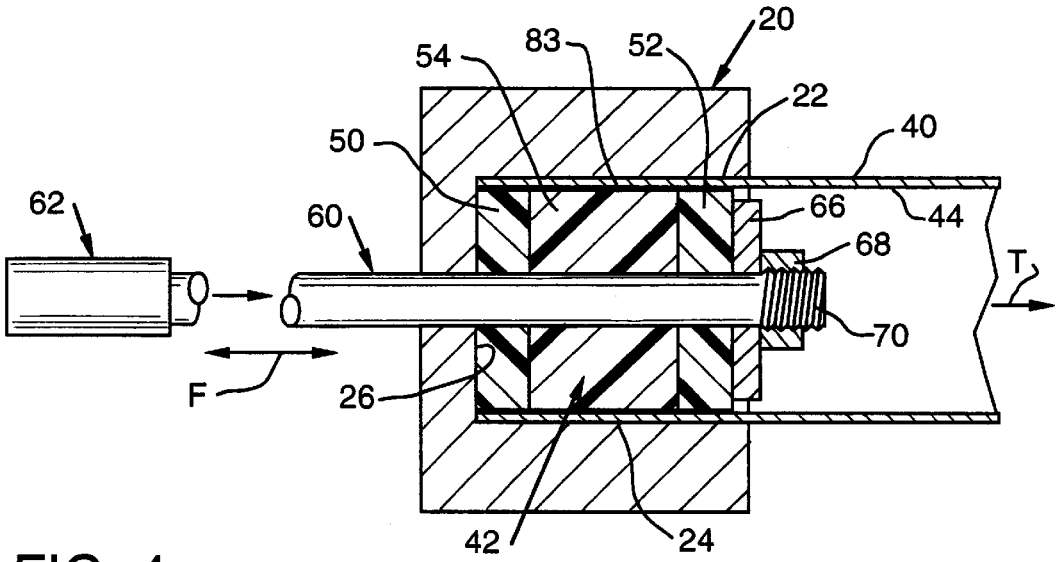
FIG. 4 is a cross-sectional illustration of the apparatus of FIG. 3 taken through 4—4.

Referring to the embodiment shown in FIGS. 3 and 4, the apparatus has an outer tool 20, which may be made of steel, which has a recess defined by lateral walls 22,24 and the contiguous walls 23,25, as well as a base wall 26. In the embodiment shown in these figures, the metal extrusion 28, which may be aluminum, has a first hollow area 30 and an adjacent hollow area 32 divided by a wall 34. It is noted that neither hollow area is symmetrical about the longitudinal axis. The invention would also work well with an extrusion having a circular cross-section or other symmetrical cross-section. The hollow tubular workpiece 28 has a circumferential wall 40. Within each end is a resilient mandrel, such as 42, in the left hollow of FIG. 4, which is generally axially elongated, and has an outer surface of complementary configuration to the inner surface 44 of the tubular workpiece end. While the resilient mandrel may be composed of a single material, preferably having a durometer hardness in the range of about 50 A to 95 A, in the form illustrated, the resilient mandrel 42 has a pair of end portions 50,52, which are of a first durometer hardness, which may be on the order of about 70 A to 95 A and a center portion 54 disposed therebetween which will have lesser durometer hardness which may be on the order of about 50 A to 70 A. An elongated rod 60 is either the piston rod of hydraulic cylinder 62, or is operatively associated therewith, so as to reciprocate in the direction indicated by arrows F. An end cap 66 is secured adjacent to portion 52 of the resilient mandrel 42 and is secured in place by nut 68, which is secured to threaded portion 70 of the rod 60. Similarly, as shown in FIG. 3, a rod 80 is secured by nut 82 to end cap 66 so as to facilitate compression of the resilient mandrel 81 in hollow 30. When rod 60 is under the influence of hydraulic cylinder 62, moved to the left, a compressive force is applied to the resilient mandrel 42 as a result of its being compressed between base wall 26 of the recess in outer tool 20 and end cap 66. This generally axially applied force causes transverse expansion of the resilient mandrel 42 so as to clamp the end 83 of the tubular member 40 between the resilient mandrel 42 and the lateral wall, such as 22,24 of the outer tool recess. In this manner, when a tensile force is applied in the direction shown by arrow T in FIG. 4, the end 83 will be firmly held in position without damaging jaw contact therewith. A similar gripping system will be secured to the other end of the tubular workpiece 28. A similar force applying system will be provided for mandrel 81. When there are multiple hollow extrusions, the compressive forces simultaneously effect axial compression of the resilient mandrels.

In a preferred embodiment of the invention, the resilient mandrels will be polyurethane or a material of similar properties in respect of resiliency, strength, and durability, which preferably has a durometer hardness in the range of 70 A to 95 A. If desired, in lieu of a single resilient material, the sandwich approach shown in FIG. 4, employing segments of different durometer hardness, may be employed. Depending upon the resilient material selected and tooling dimensions, the amount of axial compression of the resilient mandrel required to effect workpiece gripping may be about 0.1 to 0.4 inch.

If desired, the compressive force applied to the resilient mandrel may be such that it will actually cooperate with the recess portion of the outer tool to reform the tubular member end.

Depending upon the nature of the specific material employed in the resilient mandrel, it generally will be preferable to apply a compressive pressure of about 4000 psi to 6000 psi to the mandrel in effecting clamping action.

After the tubular workpiece has been clamped, the forming operation takes place by stretching the tubular workpiece beyond the yield point, effecting the desired forming, after which the compressive force is withdrawn, thereby permitting removal of the formed tubular workpiece from the gripping apparatus.

For example, after clamping, the workpiece may be subjected to tensile forces which stretch the tubular member beyond the yield point, after which bending may occur so as to permanently deform the tubular member to the desired configuration.

Figure 5:
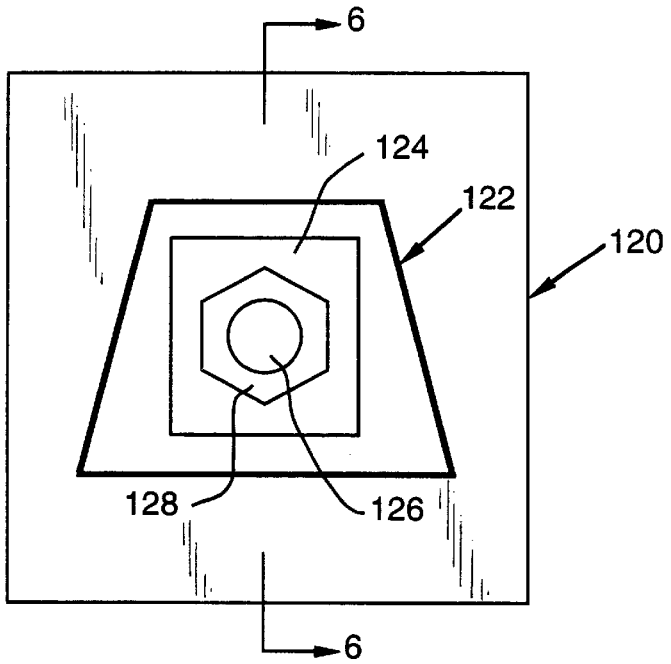
FIG. 5 is a cross-sectional illustration of a single hollow metal tubular member in a form of apparatus of the present invention.
Figure 6:
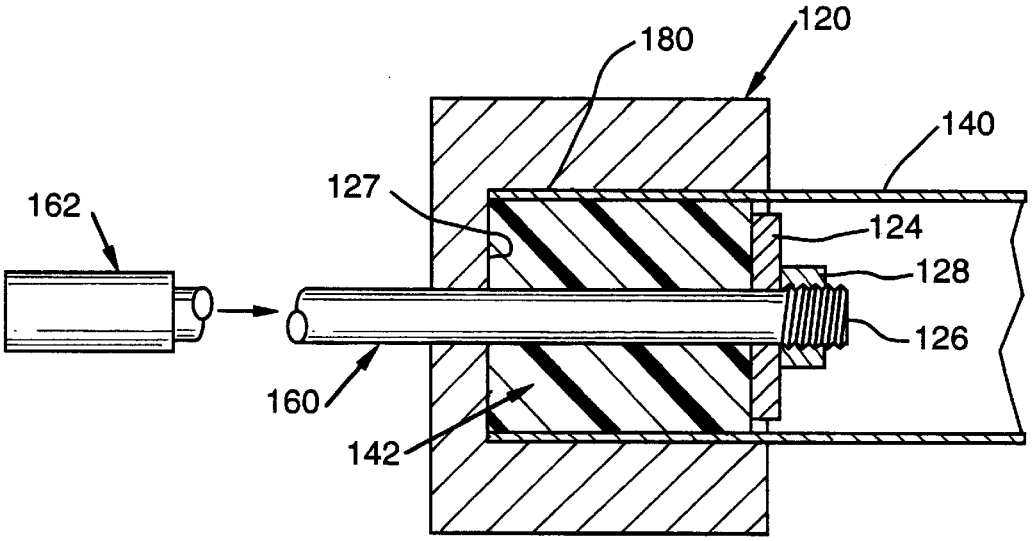
FIG. 6 is a cross-sectional illustration taken through 6—6 of FIG. 5.

Referring to FIGS. 5 and 6, another embodiment of the invention will be considered. In this embodiment, the outer tool 120 has a recess which receives the tubular member 122 which, in form shown, has a generally trapezoidal configuration. An end cap 124 is secured to rod 126 by means of internally threaded nut 128. It will be appreciated that in this embodiment, the hollow member 122 has a single hollow and the peripheral wall is not symmetrical with respect to the longitudinal axis of the hollow member 122. Rod 126 is operatively associated with hydraulic cylinder 162 and through reciprocating movement applies and withdraws a compressive force to resilient mandrel member 142 which, in this embodiment, is shown as being made from a single material. The hollow member 140 has an end 180 which employs the base wall 127 of the recess as a stop to limit inward penetration of the end 180 into the outer tool 120.

For numerous uses as structural members in a vehicle, aluminum extrusions of single hollow or multiple hollow type may be employed. The invention may be employed with any aluminum alloys for use in such applications. The extrusions may have a wall thickness depending on particular use of about 1.0 to 6 mm, for example.

It will be appreciated that in the embodiments illustrated, the resilient mandrels 42, 81, 142, in the uncompressed state, have an axial extent equal to or less than the axial extent of the recess in the outer tool 20,120.

In general, in terms of economics and performance characteristics, it will be desirable to have the outer tool 20,120, the rod 60,160, and the end cap 66,124, all made of a suitable steel.

While a presently preferred method of applying the compressive force is a hydraulic cylinder, it will be apparent to those skilled in the art that other means, such as a wedge or screw system, for example, may be employed.

Figure 7A:
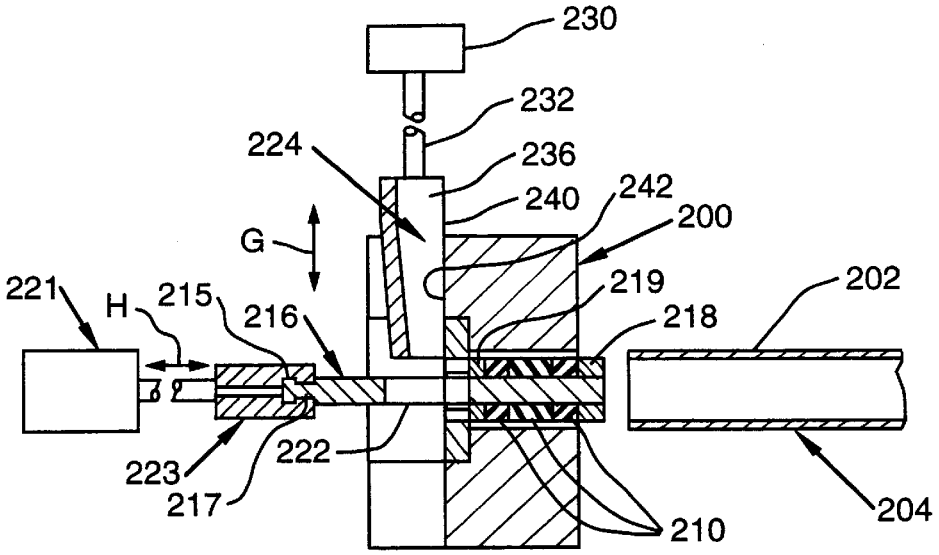
FIGS. 7A through 7C show schematically cross-sectional views of an alternate means for effecting gripping of a tubular workpiece.
Figure 7B:
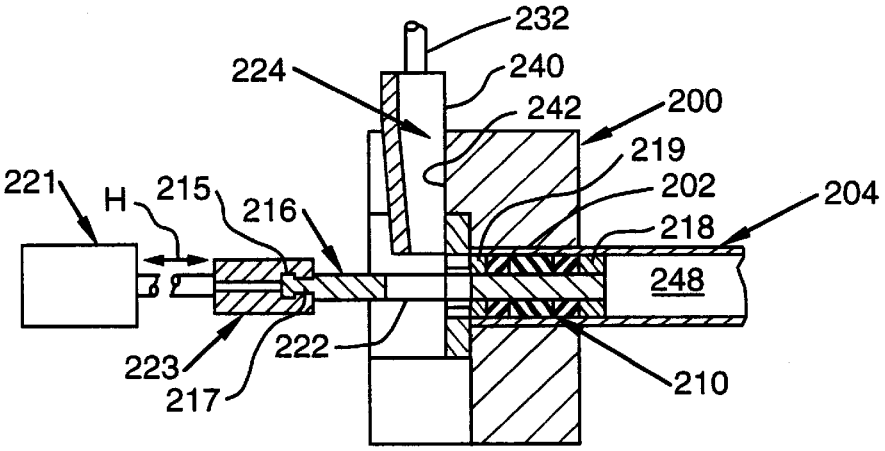
Figure 7C:
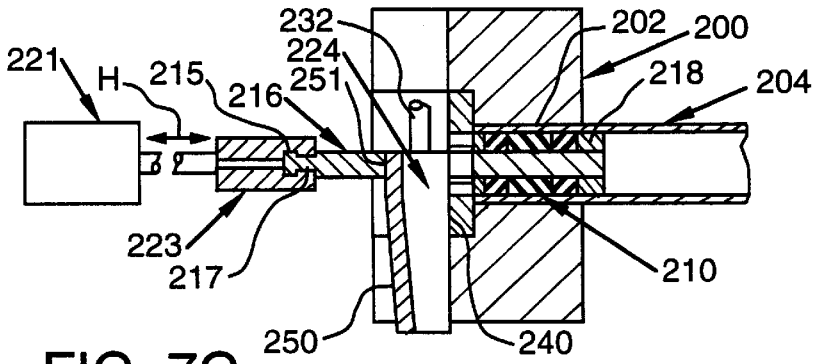
Figure 7D:
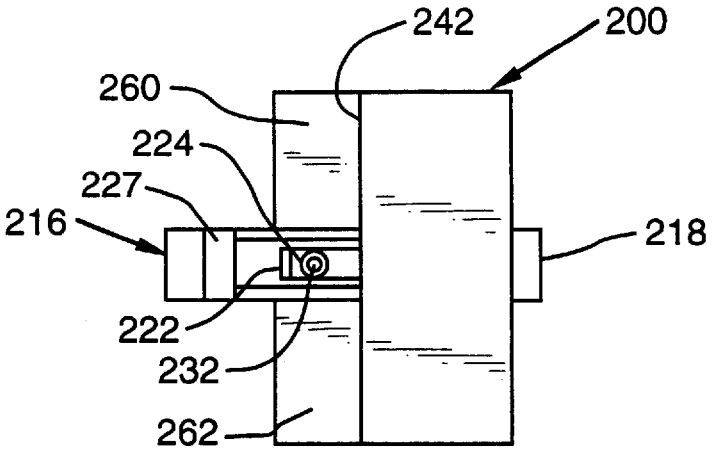
FIGS. 7D and 7E are respectively top plan and left side elevational views of the apparatus of FIG. 7A.

Referring to FIGS. 7A–7E, an alternate means for effecting and maintaining axial compression to effect gripping of the end of a tubular workpiece will be considered. An outer tool 200, having a recess for receiving end 202 of workpiece 204, receives a resilient mandrel 210 which is, in the form shown, is a plurality of segments of generally annular shape having a pull rod 216 extending therethrough. An enlarged metal cap 218 is secured to the end of the pull rod 216 closest to the workpiece 204. Metal retainer cap 219 slidingly receives the pull rod 216 on the other side of the resilient mandrel 210. The pull rod 216 has a generally axially oriented wedge receiving opening 222 (FIG. 7D). In the form shown, the upper portion 236 of wedge 224 is generally rectangular in plan. In FIG. 7A, the workpiece 204 has not entered tool 200 and, in FIG. 7B, it has. In operation, hydraulic cylinder 221 applies reciprocating movement in the direction of double headed arrow H which, through notched coupling 223, is interengaged with pull rod 216 which has an end portion 215 and reduced diameter portion 217 engaged with coupling 223. When the pull rod 216 is moved to the left so as to achieve the desired axial compression and radial expansion of resilient mandrel 210, as shown in FIG. 7C, actuator 230 lowers wedge 224 into wedge receiving opening 222 with wedge flat surface 240 and wedge tapered surface 250 serving to guide the wedge 224. Flat surfaces 240, 251 will retain the wedge in opening 222 to retain the resilient mandrel in clamping position without ongoing action of hydraulic cylinder 231. The cycle is reversed after forming of workpiece 204 to resume the position of FIG. 7A. The wedge 224, therefore, reciprocates in the direction of double headed arrow G. During movement of wedge 224, wedge surface 240 is in sliding contact with tool surface 242.

Figure 7E:
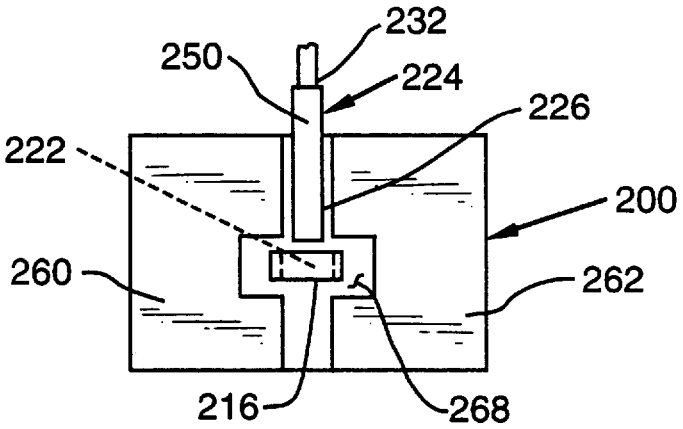

FIGS. 7D and 7E show, respectively, top plan and left side elevational views of the wedge 224 and pull rod 216 with notches, such as upper notch 227 and associated portions of outer tool 200. Projections 260,262 have recesses which defines a passageway 268 for wedge 224. Recess 268 provides a passage for pull rod 216 reciprocation.

Figure 8:
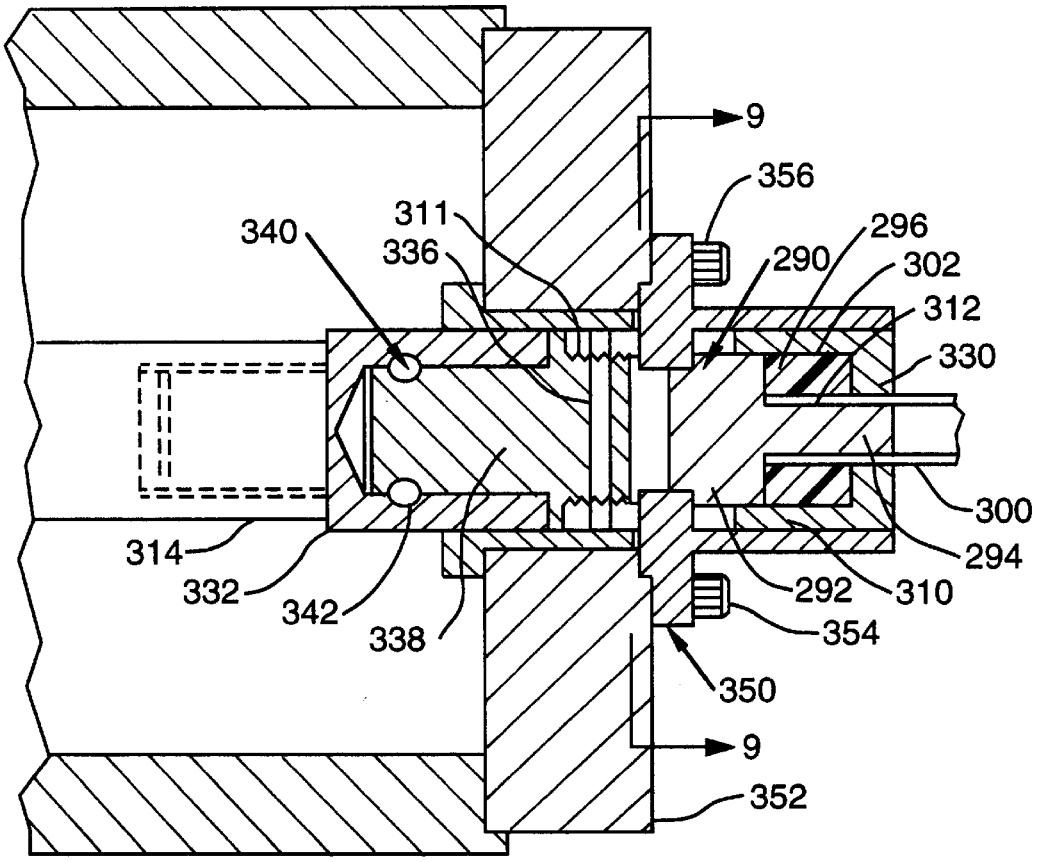
FIG. 8 is a cross-sectional illustration of another embodiment of the apparatus for gripping the workpiece.
Figure 9:
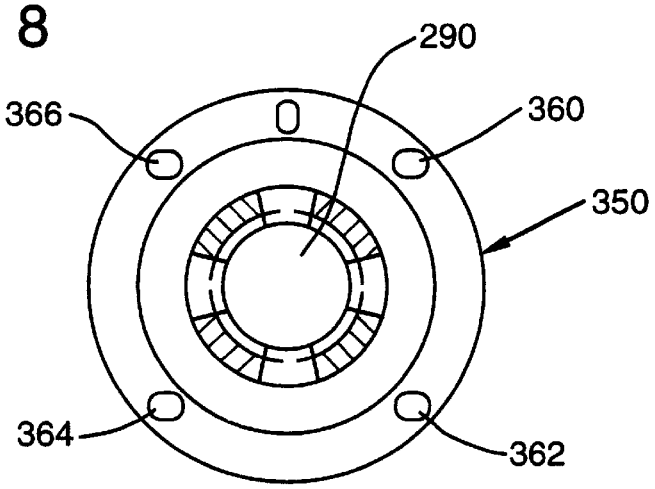
FIG. 9 is a cross-sectional illustration of the gripping apparatus of FIG. 8 taken through 9—9.

FIGS. 8 and 9 show a modified form of the invention wherein a solid internal mandrel 290 has a large diameter portion 292 coaxial with and preferably integrally formed with a reduced diameter portion 294. An annular resilient gripping member 296 is in spaced surrounding position with respect to said reduced diameter portion 294. The tubular workpiece 300 has an end 312 received between the resilient tool 296 and reduced diameter portion 294. The outer surface 302 of the resilient tool 296 is preferably of the same diameter or other outside dimension as said large diameter portion 292. The axial extent of resilient tool or sleeve 296, in the form shown, is less than the axial extent of inner mandrel portion 294. Pull rod 310 restrains the resilient tool or sleeve 296 against radially outward expansion responsive to application of axially compressive force thereto. As a result, axially applied compressive force will cause the tool or sleeve 296 to expand radially inwardly and clamp the end 312 of workpiece 300 between the sleeve 296 and reduced diameter mandrel portion 294.

Compressive force is applied to resilient sleeve 296 by reciprocation of cylinder rod 314 which is moved by suitable means, such as an hydraulic cylinder (not shown). Moving cylinder rod 314 to the left in FIG. 8 causes the pull rod 310 to move to the left and compress resilient sleeve 296 to thereby urge it radially inwardly to clamp the workpiece end 312. The pull rod 310 has a flange 330 which restrains the resilient sleeve 330. The pull rod 310 is secured to adapter 332 by assembly pin 336 and threads on the exterior of rod 338 which engage threads on the interior of pull rod 310. These interengaged threads are indicated generally by reference number 311. Universal mounting rod 338 is demountably connected to adapter through retaining keys 340,342. Gripper housing 350 is secured to front plate 352 by bolts, such as those numbered 354,356 which are received in housing openings, such as 360,362,364,366 (FIG. 9), for example. While in the form illustrated the tubular member or workpiece 300 is circular and, therefore, substantially symmetrical about its longitudinal axis, the embodiment is usable with tubular workpieces which are not symmetrical about their longitudinal axis. This embodiment can be used with single or multiple hollow workpieces.

Figure 10:
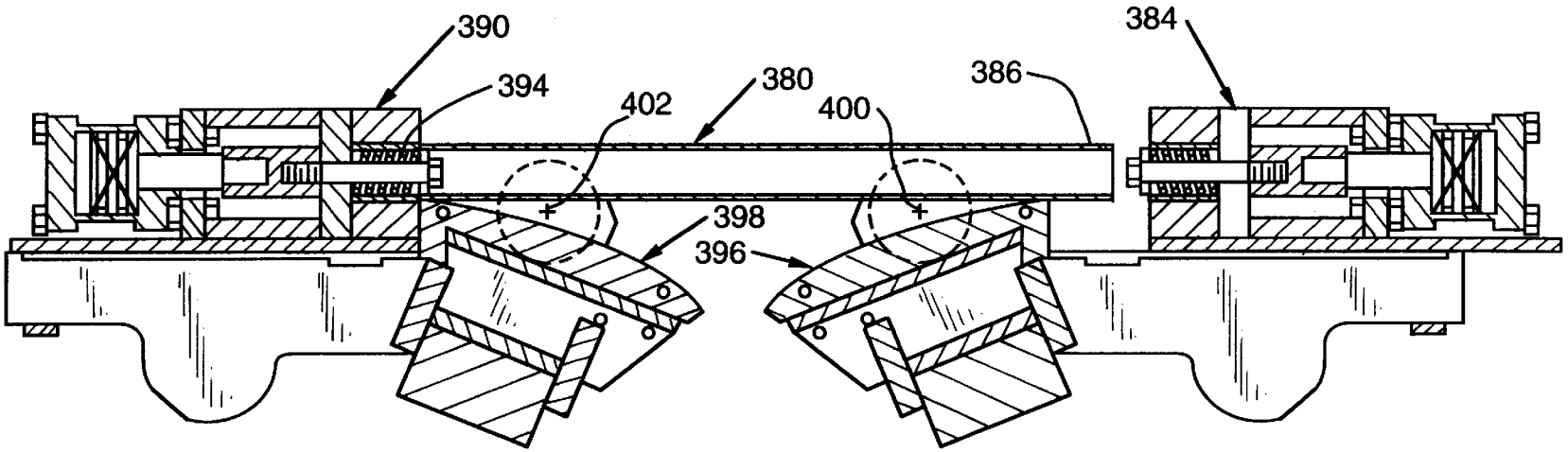
FIGS. 10 and 11, respectively, are cross-sectional illustrations of the gripping apparatus and a workpiece before and after forming.
Figure 11:
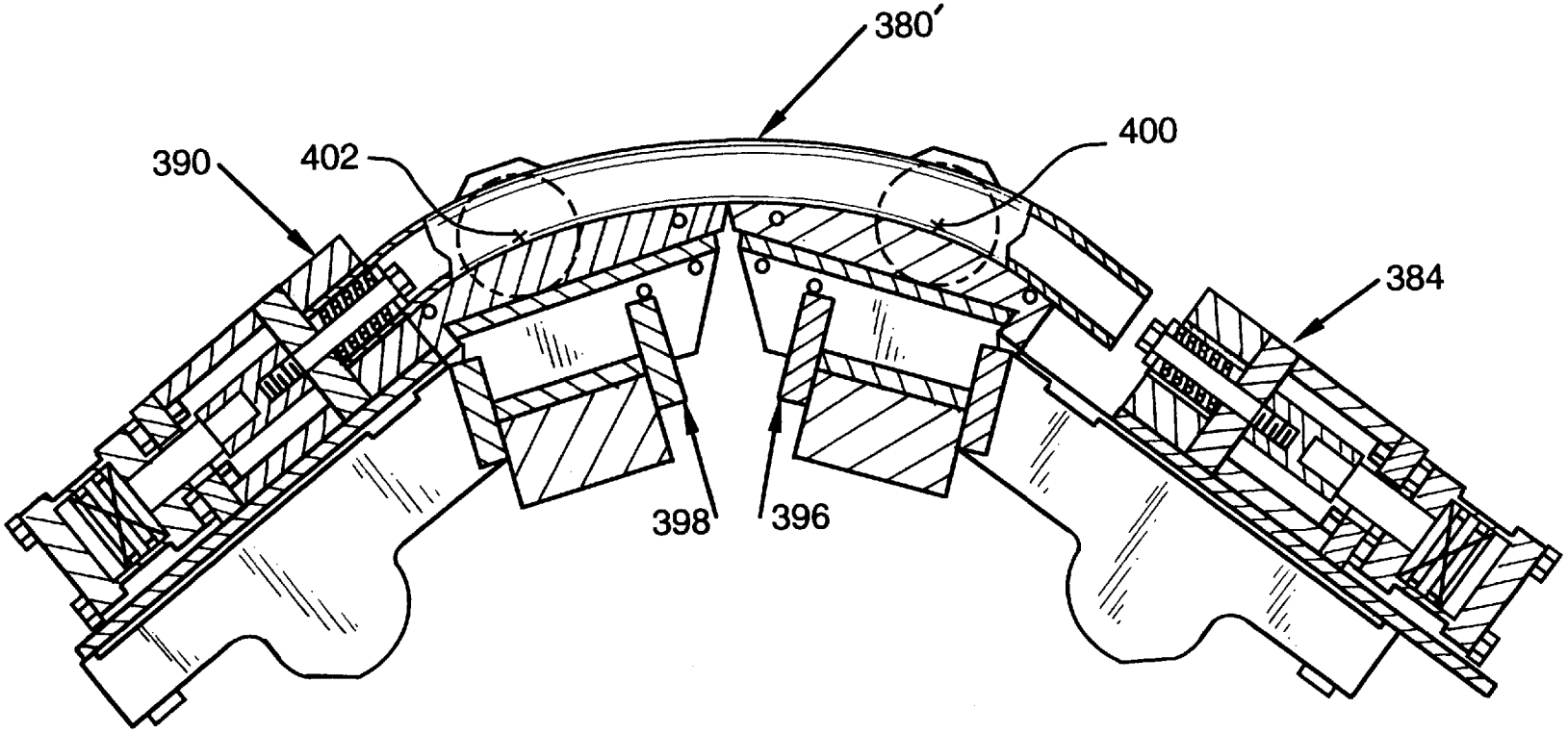

Referring to FIG. 10, a first gripper 384 is shown not engaged with elongated, straight tubular workpiece end 386. The other gripper 390 is shown clamping the other end 394 of workpiece end 380. This embodiment of the grippers 384,390 may be the same as shown in FIG. 3–7E hereof. The forming dies 396,398 are respectively adapted to rotate clockwise about axis 400 and counterclockwise about axis 402. After clamping both ends 386,394 the forming dies 396,398 are rotated to stretch the workpiece 380 beyond the yield point and bend it to the desired configuration, as shown in workpiece 380 in FIG. 11, after which the clamping means 384,390 are withdrawn and the workpiece removed. The forming dies 384,390 are then rotated back to the position shown in FIG. 1 and a new workpiece is put in place.

EXAMPLE

By way of an example of a suitable assembly for the gripper of FIGS. 3–7E, an aluminum extrusion made from alloy 6061 having an average wall thickness of 3.5 mm, was employed with a sandwiched polyurethane resilient mandrel having durometer hardnesses of 70 A and 95 A with the durometer hardness being lower in the inner portion of the resilient mandrel, than in the outer portion. A generally axially applied compressive pressure of about 6000 psi was applied to the mandrel in order to clamp the tubular extrusion end between the mandrel and the inner surface of an outer tool having a recess within which the end was received. Separate mandrels and outer tools were provided to clamp each end of the aluminum extrusion. The aluminum extrusion initially had a generally straight configuration and a length of about 44 inches. When the portions were bent, the overall length measured directly from end to end at the inner portions of the ends, as distinguished from being measured along the tube, was reduced to about 39 inches.

It will be appreciated, therefore, that the present invention provides an efficient means for gripping hollow tubular workpieces, such as aluminum extrusions, for example, bumper beams to be subjected to forming operations while minimizing or eliminating scrap generated in these end portions. All of this is accomplished in an economical manner which is compatible with existing forming equipment.

Whereas particular embodiments of the invention have been described herein for purposes of illustration, it will be appreciated by those skilled in the art that numerous variations of the details may be made without departing from the invention as described in the appended claims.

We claim:

1. A method of gripping a metal tubular member during a forming operation comprising providing an outer tool having a recess structured to receive an end of said tubular member, inserting a resilient mandrel into said end of said tubular member, inserting said tubular member into said recess and applying a compressive force to said resilient mandrel in a direction aligned generally axially of said tubular member to establish transverse expansion of said resilient mandrel to clamp said end between said mandrel and said outer tool recess with sufficient force to capture the tubular member within the recess of the outer tool, urge the tubular member into intimate contact with the outer tool recess, and support said tubular member against axial loads during the forming operation, and forming said tube over an area peripheral to said end received with the recess of the outer tool while maintaining said clamping of said end.

2. The method of claim 1 including providing said outer tool recess with a base wall and a lateral wall of generally complementary shape to the outer surface of said tubular member, and applying sufficient said compressive force to urge said tubular member into intimate contact with said outer tool recess lateral wall.

3. The method of claim 2 including providing said resilient mandrel with an outer surface which is generally complementary to the inner surface of said tubular member end.

4. The method of claim 3 including effecting said axial compression of said resilient mandrel by means of an hydraulic cylinder.

5. The method of claim 3 including inserting said resilient mandrel containing tubular member into said outer tool recess until said end abuts said recess base wall, passing an elongated rod through said resilient mandrel and securing said rod to an end cap disposed at one end of said resilient mandrel, and moving said rod axially in a first direction to compress said resilient mandrel within said outer tool recess and thereby cause transverse expansion of said resilient mandrel and subsequently moving said rod in a second direction to remove said compressive force.

6. The method of claim 2 including employing polyurethane in said resilient mandrel.

7. The method of claim 2 including applying sufficient generally axial compressive force on said resilient mandrel to effect transversely outward deformation of said tubular member.

8. The method of claim 2 including employing said process on a single hollow aluminum extrusion.

9. The method of claim 2 including employing said method in forming structural components for a vehicle.

10. The method of claim 9 including applying as said compressive force a pressure in the range of about 4000 psi to 6000 psi.

11. The method of claim 2 including subsequent to said forming operation withdrawing said compressive force to facilitate removal of said tubular member from said outer tool recess.

12. The method of claim 9 including employing said process on tubular members which have one or more hollow portions which are not symmetrical about their longitudinal axes.

13. The method of claim 2 including employing said process on a tubular member having one or more hollow portions which are symmetrical about their longitudinal axes.

14. The method of claim 12 including employing said method on a tubular member having two said hollow portions.

15. A method of gripping a metal tubular member during a forming operation comprising providing an outer tool having a recess structured to receive an end of said tubular member, inserting a resilient mandrel into said end of said tubular member, the resilient mandrel employing a first resilient material having a first durometer hardness in the end portions of said resilient mandrel and a second resilient material having a second durometer hardness less than the durometer hardness of said first resilient material in the portions of said resilient mandrel disposed between said mandrel end portions, inserting said tubular member into said recess and applying a compressive force to said resilient mandrel in a direction aligned generally axially of said tubular member to establish transverse expansion of said resilient mandrel to clamp said end between said mandrel and said outer tool recess, and forming said tube while maintaining said clamping of said end.

16. A method of gripping a metal tubular member having multiple hollow extrusion during a forming operation comprising providing an outer tool having a recess structured to receive an end of said tubular member, inserting a resilient mandrel into each of said end of said multiple hollow metal extrusion, inserting said tubular member into said recess and applying a compressive force to each of said resilient mandrels in a direction aligned generally axially of said tubular member to establish transverse expansion of said resilient mandrel to clamp said end between said mandrels and said outer tool recess, and forming said tube while maintaining said clamping of said end.

17. The method of claim 16 including substantially simultaneously effecting axial compression of each said resilient mandrel.

18. A method of gripping a tubular member during a forming operation comprising providing an outer tool having a recess structured to receive an end of said tubular member, inserting a resilient mandrel into said end of said tubular member, inserting said tubular member into said recess and applying a compressive force to said resilient mandrel in a direction aligned generally axially of said tubular member to establish traverse expansion of said resilient mandrel to clamp said end between said mandrel and said outer tool recess, and forming said tube by stretching said tubular member substantially at or beyond its yield point and then bending said tubular member while maintaining said clamping of said end.

19. A method of gripping a metal tubular member during a forming operation comprising providing an outer tool having a recess structured to received an end of said tubular member, inserting a resilient mandrel into said end of said tubular member, inserting said tubular member into said recess and applying a compressive force to said resilient mandrel in a direction aligned generally axially of said tubular member to establish traverse expansion of said resilient mandrel to clamp said end between said mandrel and said outer tool recess, inserting a mechanical lock to maintain the applied compressive force to said resilient mandrel until the forming operation is substantially complete, and forming said tube while maintaining said clamping of said end.

20. The method of claim 19 wherein the mechanical lock is a wedge.

21. Apparatus for gripping a tubular member during a forming operation comprising an outer tool having a recess with lateral walls of generally complementary configuration to the outer surface of said tubular member, a resilient mandrel receivable within the end of said tubular member to be gripped, and force applying means for applying a compressive force to said resilient mandrel in a direction generally axially of said tubular member to establish responsive transverse expansion of said resilient mandrel to clamp said tubular member and within said recess between said resilient mandrel said lateral wall with sufficient force to capture the tubular member within the recess of the outer tool, urge the tubular member into intimate contact with the outer tool recess, and support the tubular member against axial loads during the forming operation over an area peripheral to said end received within the recess of the outer tool.

22. The apparatus of claim 21 including said recess being defined by a base wall and said lateral walls, and said base wall serving as a stop for insertion of said tubular member end.

23. The apparatus of claim 22 including said resilient mandrel being compressible against said base wall.

24. The apparatus of claim 21 including said force applying means including hydraulic cylinder means.

25. The apparatus of claim 21 including said outer tool recess being structured to receive tubular members which have at least one hollow which is not symmetrical about its longitudinal axis.

26. The apparatus of claim 24 including said resilient mandrel having an uncompressed axial extent equal to or less than the axial extent of said recess.

27. The apparatus of claim 24 including an elongated rod reciprocable by said hydraulic cylinder means in a first direction to apply a compressive force to said resilient mandrel and in a second direction to terminate application of said compressive force, and said resilient mandrel having a passageway for receipt of said rod.

28. The apparatus of claim 21 including said resilient mandrel being composed of polyurethane.

29. The apparatus of claim 21 including said force applying means being adapted to apply as said compressive force a pressure in the range of about 4000 psi to 6000 psi.

30. Apparatus for gripping a tubular member having multiple hollow extrusions during a forming operation comprising an outer tool having a recess with lateral walls of generally complementary configuration to the outer surface of said tubular member, said outer tool recess being structured to receive a multiple hollow tubular member, a resilient mandrel receivable within the end of said tubular member to be gripped, and force applying means for applying a compressive force to said resilient mandrel in a direction generally axially of said tubular member to establish responsive transverse expansion of said resilient mandrel to clamp said tubular member within said recess between said resilient mandrel and said lateral wall.

31. Apparatus for gripping a tubular member during a forming operation comprising an outer tool having a recess with lateral walls of generally complementary configuration to the outer surface of said tubular member, a resilient mandrel receivable within said end of said tubular member to be gripped, said resilient mandrel having a first resilient material of a first durometer hardness in the axial end portions of said resilient mandrel and a second resilient mandrel having a second durometer hardness less than said first durometer hardness in the portions of said resilient mandrel disposed between said end portions, and force applying means for applying a compressive force to said resilient mandrel in a direction generally axially of said tubular member to establish responsive transverse expansion of said resilient mandrel to clamp said tubular member within said recess between said resilient mandrel and said lateral wall.

32. Apparatus for gripping a tubular member during a forming operation comprising an outer tool having a recess with lateral walls of generally complementary configuration to the outer surface of said tubular member, a resilient mandrel receivable within said end of said tubular member to be gripped, force applying means for applying a compressive force to said resilient mandrel in a direction generally axially of said tubular member to establish responsive transverse expansion of said resilient mandrel to clamp said tubular member within said recess between said resilient mandrel and said lateral wall, and a mechanical lock for locking the force applying means and maintaining said compressive force so long as the mechanical lock is in the locked position.

33. The apparatus of claim 32 wherein the mechanical lock is a wedge means which maintains the compressive force on said resilient mandrel.

34. The method of making a structural component of a vehicle from a tubular member comprising providing a pair of outer tools each having a recess structured to receive and clamp an end of said tubular member, inserting a resilient mandrel into each end of said tubular member, inserting said tubular ends into said outer tool recesses, applying compressive forces in a generally axial direction to each resilient mandrel in order to urge the same transversely outwardly so as to clamp said tubular member ends between said resilient mandrel and said outer tool recess with the compressive force sufficient to urge the tubular member into intimate contact with the outer tool recess, applying tensile force to said tubular member to stretch it beyond the yield point and subsequently forming said tubular member, and withdrawing said compressive force to unclamp the ends of said tubular member.

35. The method of claim 34 including effecting said forming by bending said tubular member.

36. The method of claim 35 including employing said method to make a vehicle structural component.

37. The method of claim 36 including employing said method on a tubular member which is an aluminum extrusion.

38. The method of claim 34 including employing said method on an extrusion which has multiple hollow portions.

39. The method of claim 38 including providing said resilient mandrel with an outer surface which is generally complimentary to the inner surface of said tubular member end.

40. The method of claim 39 including effecting said axial compression of said resilient mandrel by means of an hydraulic cylinder.

41. The method of claim 40 including said recesses having a base wall and a lateral wall, inserting said resilient mandrel containing tubular member into said outer tool recess until said end abuts said recess base wall, passing an elongated rod through said resilient mandrel and securing said rod to an end cap disposed at one end of said resilient mandrel, and moving said rod axially in a first direction to compress said resilient mandrel within said outer tool recess and thereby cause said transverse expansion of said resilient mandrel and subsequently in a second direction to remove said compressive force.

42. The method of claim 41 including employing polyurethane in said resilient mandrel.

43. The method of claim 42 including employing a first resilient material having a first durometer hardness in the end portions of said resilient mandrel and a second resilient material having a second durometer hardness less than the durometer hardness of said first resilient material in the portions of said resilient mandrel disposed between said mandrel end portions.

44. The method of claim 34 including applying sufficient generally axial compressive force on said resilient mandrel to effect transversely outward deformation of said tubular member.

45. The method of claim 44 including applying as said compressive force a force in the range of about 4000 psi to 6000 psi.

46. The method of claim 35 including employing said method in making an aluminum extrusion.

47. The method of claim 39 including maintaining said axial compression of said resilient mandrel by wedge means.

48. A method of gripping a metal tubular member during a forming operation comprising providing an outer tool having a recess structured to receive an end of said tubular member, inserting a resilient mandrel into said end of said tubular member, inserting said tubular member into said recess and applying a compressive force to said resilient mandrel in a direction aligned generally axially of said tubular member to establish transverse expansion of said resilient mandrel with sufficient compressive force to urge the tubular member into intimate contact with the outer tool recess, to clamp said end between said mandrel and said outer tool recess with sufficient retaining force to support the tubular member against axial loading, maintaining the compressive force on said resilient mandrel until the forming operation is complete, and forming said tube over an area peripheral to the end of the tubular member received within the recess of the outer tool while maintaining said clamping of said end.

49. The method of gripping a tubular member during a forming operation of claim 48 wherein said mandrel is constructed from a rigid material and said outer tool includes an annular resilient sleeve including the step of placing said annular resilient sleeve on the exterior of said tube member, and the applying step applies a compressive force to said resilient sleeve to create resilient radially inwardly expansion of said sleeve to grip said tube end between said substantially rigid inner mandrel and said resilient sleeve.

50. The method of claim 49 including subsequently to said gripping terminating application of said axial compressive force to permit said resilient sleeve to return to its original position and unclamp said tubular member.

51. The method of claim 50 including restraining said resilient sleeve during said application of said axial compressive force to resist resilient radially outward and axial expansion of said resilient sleeve.

52. The method of claim 51 including applying said compressive force as a pressure in the range of about 4000 psi to 6000 psi.

53. The method of claim 50 including employing said method on a tubular member which is substantially symmetrical about its longitudinal axis.

54. The method of claim 50 including employing said method on a tubular member which is not symmetrical about its longitudinal axis.

55. The method of claim 50 including providing said inner mandrel with a first axial portion which is received within said tubular member and said end of an adjacent coaxial second portion of enlarged transverse extent with respect to said first axial portion, and employing said coaxial second portion in the application of said generally axial compressive forces to said resilient sleeve.

56. The method of claim 49 including gripping both ends of said tubular member.

57. A method of gripping a metal tubular member during a forming operation comprising providing an outer tool having a recess structured to receive an end of said tubular member, inserting a mandrel into said end of said tubular member, inserting said tubular member into said recess and applying a compressive force to a resilient component of either said outer tool or said mandrel, in a direction aligned generally parallel to the axis of the tubular member to establish transverse expansion of said resilient component with sufficient compressive force to urge the tubular member into intimate contact with the outer tool recess, to clamp said end between said mandrel and said outer tool recess with sufficient sustained force to retain the end of said tubular member in said recess and support said tubular member against axial loads during the forming operation, and forming said tube over an area peripheral said outer tool while maintaining said clamping of said end.

58. Apparatus for gripping a tubular member during a forming operation comprising an inner mandrel for insertion into an end of said tubular member, an outer tool having a recess structured to receive an end of said tubular member, and force applying means cooperating with either said outer tool or said mandrel for applying a compressive force to a resilient component of either said outer tool or said mandrel, in a direction aligned generally parallel to the axis of the tubular member to establish transverse expansion of said resilient component with sufficient compressive force to urge the tubular member into intimate contact with the outer tool recess, to clamp said end between said mandrel and said outer tool recess with sufficient sustained force to retain the end of said tubular member in said recess and support said tubular member against axial loads during the forming operation over an area of the tubular member peripheral of said outer tool.

59. The apparatus of claim 58 wherein the inner mandrel is constructed from a rigid material and said outer tool includes a resilient sleeve structured to be received on the exterior of said end of said tubular member, and wherein the force applying means applies a compressive force to said resilient sleeve in a direction generally parallel to the axis of the tubular member to establish responsive transverse inward expansion of said resilient sleeve to thereby clamp said tubular member end between said resilient sleeve and said inner mandrel.

60. The apparatus of claim 59 including said inner mandrel having a first axial portion of a first transverse dimension receivable within said tubular member end and a second axial portion of enlarged transverse dimension with respect to said first axial portion.

61. The apparatus of claim 60 including said second axial portion employable to apply said compressive force.

62. The apparatus of claim 59 including restraining means for resisting outward expansion of said resilient sleeve during application of said compressive force.

63. The apparatus of claim 61 including said first axial portion of said inner mandrel being generally cylindrical, and said second axial portion being generally cylindrical.

* * * * *